US008089338B2

(12) United States Patent
Yan et al.

(10) Patent No.: US 8,089,338 B2
(45) Date of Patent: Jan. 3, 2012

(54) VARIABLE ATTENUATOR

(75) Inventors: Yuejun Yan, Shenzhen (CN); Yuepeng Yan, Shenzhen (CN)

(73) Assignee: Yantel Corporation, Shenzhen (CN)

( * ) Notice: Subject to any disclaimer, the term of this patent is extended or adjusted under 35 U.S.C. 154(b) by 1144 days.

(21) Appl. No.: 11/733,205

(22) Filed: Apr. 10, 2007

(65) Prior Publication Data

US 2007/0176730 A1 Aug. 2, 2007

Related U.S. Application Data

(63) Continuation-in-part of application No. PCT/CN2005/000872, filed on Jun. 17, 2005.

(30) Foreign Application Priority Data

Oct. 13, 2004 (CN) ..... 2004 1 0051879
Nov. 11, 2006 (CN) ..... 2006 1 0156824

(51) Int. Cl.
*H01C 1/012* (2006.01)

(52) U.S. Cl. ..... 338/308; 338/309
(58) Field of Classification Search ..... 338/160–162
See application file for complete search history.

(56) References Cited

U.S. PATENT DOCUMENTS

| | | | | |
|---|---|---|---|---|
| 5,051,719 | A * | 9/1991 | Gaston et al. | 338/162 |
| 6,483,421 | B1 * | 11/2002 | Eichelmann | 338/162 |
| 6,677,849 | B1 * | 1/2004 | Kato et al. | 338/162 |
| 6,882,265 | B2 * | 4/2005 | Taguchi et al. | 338/309 |
| 2002/0050920 | A1 * | 5/2002 | Fliegner | 338/162 |

* cited by examiner

*Primary Examiner* — Kyung Lee
(74) *Attorney, Agent, or Firm* — Matthias Scholl P.C.; Matthias Scholl

(57) ABSTRACT

The invention discloses a variable attenuator, comprising two or more resistors each resistor having its own effective resistance value, and means for simultaneously short circuiting at least a portion of two or more of said resistors, whereby simultaneously changing the effective resistance values. The variable attenuator of the invention is suitable for use in various high frequency and microwave circuits and systems, and has the features of a wide frequency band, small size, easy fabrication, low cost, and so on.

23 Claims, 10 Drawing Sheets

VARIABLE ATTENUATOR

CROSS-REFERENCE TO RELATED APPLICATIONS

This application is a continuation-in-part of International Patent Application No. PCT/CN2005/000872 with an international filing date of Jun. 17, 2005, designating the United States, now pending, which claims priority benefits to the Chinese Patent Application No. 200410051879.9 filed Oct. 13, 2004. This application further claims priority benefits pursuant to 35 U.S.C §119 and the Paris Convention Treaty to the Chinese Patent Application No. 200610156824.3 filed Nov. 11, 2006 The contents of all of the above-mentioned specifications are incorporated herein by reference.

BACKGROUND OF THE INVENTION

1. Field of the Invention

This invention relates to variable attenuators in the electronics and communication fields, and more particularly, to microstrip variable attenuators suitable for use in various high frequency and/or microwave circuits and systems.

2. Description of the Related Art

In the family of electronic components, the variable attenuator is one of the common and basic components in electrical circuits and systems. The existence of a variable attenuator makes the fabrication of electrical circuits and the debugging of systems more flexible and convenient. Currently, the variable attenuator is being widely used in circuits and systems with operating frequencies below a few hundred megahertz (MHz). For example, in CATV (Community Antenna Television) systems and microwave circuits, the variable attenuator is used for testing, regulating power levels, increasing isolation, etc. However, as the operating frequency is in a comparatively high frequency band, the current three-dimensional variable attenuator which is made of a contact spring, a slide block, a guide screw, and so on, has the drawbacks of large parasitic parameters and comparatively poor high frequency characteristics.

SUMMARY OF THE INVENTION

In view of the above-described problems, it is one objective of the invention to provide a variable attenuator with good wide band characteristics that is suitable for use in high frequency and/or microwave circuits and systems.

In accordance with one objective of the invention, provided is a variable attenuator comprising: a base 11, a film resistor 1 located on the base 11, and an input terminal 9 and an output terminal 10 connected to the two ends of the film resistor 1, respectively; the two ends of the film resistor 1 are also electrically connected to one end of a film resistor 6 and one end of a film resistor 7, respectively; the other ends 14 of the film resistor 6 and film resistor 7 are electrically connected to one end of the film resistor 2, and the other end of the film resistor 2 is electrically connected to a ground terminal 13; the variable attenuator further comprises a conductive sheet 3 and a conductive sheet 4 that can be electrically connected to the film resistor 1 and the film resistor 2 for changing the resistance values thereof; the variable attenuator further comprises an insulator 12 for fixing the conductive sheet 3 and the conductive sheet 4 disposed thereon.

In a class of this embodiment, the resistance value of the film resistor 6 is equal to that of the film resistor 7.

In a class of this embodiment, the position of the conductive sheet 3 and the conductive sheet 4 can be changed when moving the insulator 12 so as to change the contact area between the conductive sheet 3 and the film resistor 1 and that between the conductive sheet 4 and the film resistor 2.

In a class of this embodiment, the conductive sheet 3, the conductive sheet 4, the film resistor 1, and the film resistor 2 can be in the shape of an arc or rectangular; and the conductive sheet 3 and the conductive sheet 4 are also film resistors.

In a class of this embodiment, the common plane of the film resistor 1 and the conductive sheet 3 is without limitation in the same plane as that of the film resistor 2 and the conductive sheet 4; and the base 11 is a multi-layered base.

In a class of this embodiment, the force to change the geometrical position of the conductive sheet 3 and the conductive sheet 4 is a mechanical manual force, an automatic controlled mechanical force, an electromagnetic force, a force produced by heat or temperature, a force produced by the flow, expansion, or contraction of a liquid, or a force initiated by an optoelectronic excitation process.

In a class of this embodiment, the configuration of the variable attenuator is of a surface mount type, a pin leg lead type, or a patch cord type.

In a class of this embodiment, a silicon rubber film conductive in the vertical direction is added between the base 11 and the insulator 12.

In a class of this embodiment, a groove is disposed on the insulator 12; the conductive sheet 3 and the conductive sheet 4 are located inside of the groove; and an elastic substance is added between the conductive sheet 3 and the conductive sheet 4 within the groove.

In a second embodiment of the invention provided is a microstrip variable attenuator, comprising: a base 101, a film resistor 105 located on the base, an input terminal 102 and an output terminal 103 connected to the two ends of the film resistor 105; the two ends of the film resistor 105 are further electrically connected to one end of a film resistor 106 and one end of a film resistor 107, respectively; the other ends of the film resistor 106 and the film resistor 107 are electrically connected to a ground terminal 109; the variable attenuator of the invention further comprises a conductive sheet 110, a conductive sheet 111, and a conductive sheet 112 that can be electrically contacted by the film resistor 105, the film resistor 106, and the film resistor 107, respectively, and are used to change the resistance values of the film resistor 105, the film resistor 106, and the film resistor 107, respectively; the variable attenuator of the invention further comprises an insulator 113, on which the conductive sheet 105, the conductive sheet 106, and the conductive sheet 106 are fixed.

In a class of this embodiment, the resistance value of the film resistor 106 is equal or close to that of the film resistor 107.

In a class of this embodiment, the position of the conductive sheet 110, the conductive sheet 111, and the conductive sheet 112 can be changed when moving the insulator 113 so as to change the contact area between the conductive sheet 110 and the film resistor 105, that between the conductive sheet 111 and the film resistor 106, and that between the conductive sheet 112 and the film resistor 107.

In a class of this embodiment, the conductive sheet 110, the conductive sheet 111, the conductive sheet 112, the film resistor 105, the film resistor 106, and the film resistor 107 are in the shape of an strip arc or rectangular; the conductive sheet 110, the conductive sheet 111, and the conductive sheet 112 are also film resistors; the insulator 113 is a PCB board with conductive sheets disposed thereon, wherein the PCB board can be in the shape of a circle with an arc mouth formed on its peripheral edge.

In a class of this embodiment, the force to change the geometrical position of the conductive sheet 105, the conductive sheet 106, and the conductive sheet 107 is a mechanical manual force, an automatic controlled mechanical force, an electromagnetic force, a force produced by heat or temperature, a force produced by the flow, expansion, or contraction of a liquid, or a force initiated by an optoelectronic excitation process.

In a third embodiment of the invention provided is a microstrip variable attenuator, comprising: a base 229, a film resistor 219, a film resistor 220, a film resistor 221, an input terminal 216 and an output terminal 217 located on the base; the input terminal 216 is connected to one end of the film resistor 219, the other end of the film resistor 219 is connected to one end of the film resistor 220, and is connected to one end of the film resistor 221, the other end of the film resistor 221 is connected to the ground terminal 222; the other end of the film resistor 220 is connected to the output terminal 217; the variable attenuator of the invention further comprises a conductive sheet 223, a conductive sheet 224, and a conductive sheet 225 that can be electrically contacted by the film resistor 219, the film resistor 220, and the film resistor 221, respectively, and are used to change the resistance values of the film resistor 219, the film resistor 220, and the film resistor 221, respectively; the variable attenuator of the invention further comprises an insulator 227, on which the conductive sheet 223, the conductive sheet 224, and the conductive sheet 225 are fixed.

In a class of this embodiment, the resistance value of the film resistor 219 is equal or is close to that of the film resistor 220.

In a class of this embodiment, the position of the conductive sheet 223, the conductive sheet 224, and the conductive sheet 225 can be changed when moving the insulator 227 so as to change the contact area between the conductive sheet 223 and the film resistor 219, that between the conductive sheet 224 and the film resistor 220, and that between the conductive sheet 225 and the film resistor 221.

In a class of this embodiment, the conductive sheet 223, the conductive sheet 224, the conductive sheet 225, the film resistor 219, the film resistor 220, and the film resistor 221 are in the shape of an strip arc or rectangular; the conductive sheet 223, the conductive sheet 224, the conductive sheet 225 are also film resistors; the insulator 227 is a PCB board with conductive sheets disposed thereon, wherein the PCB board is in the shape of a circle with an arc mouth formed on its peripheral edge.

In a class of this embodiment, the force to change the geometrical position of the conductive sheet 223, the conductive sheet 224, and the conductive sheet 225 is a mechanical manual force, an automatic controlled mechanical force, an electromagnetic force, a force produced by heat or temperature, a force produced by the flow, expansion, or contraction of a liquid, or a force initiated by an optoelectronic excitation process.

Therefore, the variable attenuator according to the invention provides the following advantages:

(a) since a microstrip base structure is adopted, the range of useful frequencies for the variable attenuator is very wide; the continuous variable attenuation of a signal in the high frequency and microwave frequency range can be realized;

(b) it has a small size, is easy to adjust, and is suitable for use in various miniaturized circuits and communication circuits;

(c) it has a simple structure, and a low fabrication cost;

(d) it is suitable for various equalization circuits;

(e) it is suitable for various isolation circuits;

(f) it is suitable for various regulating circuits, controlling circuits, stabilizing circuits, and circuits for adjusting the amount of coupling;

(g) it is suitable for circuits where high attenuation is required, systematic error of an actual circuit is large, and regulation of all parts is needed to satisfy characteristics of overall circuits;

(h) it has a low insertion loss; and (i) it can serve in adjusting and testing instruments for research and development work in laboratories.

BRIEF DESCRIPTION OF THE DRAWINGS

The invention is described hereinafter with reference to accompanying drawings, in which.

DETAILED DESCRIPTION OF THE INVENTION

Figure 1:
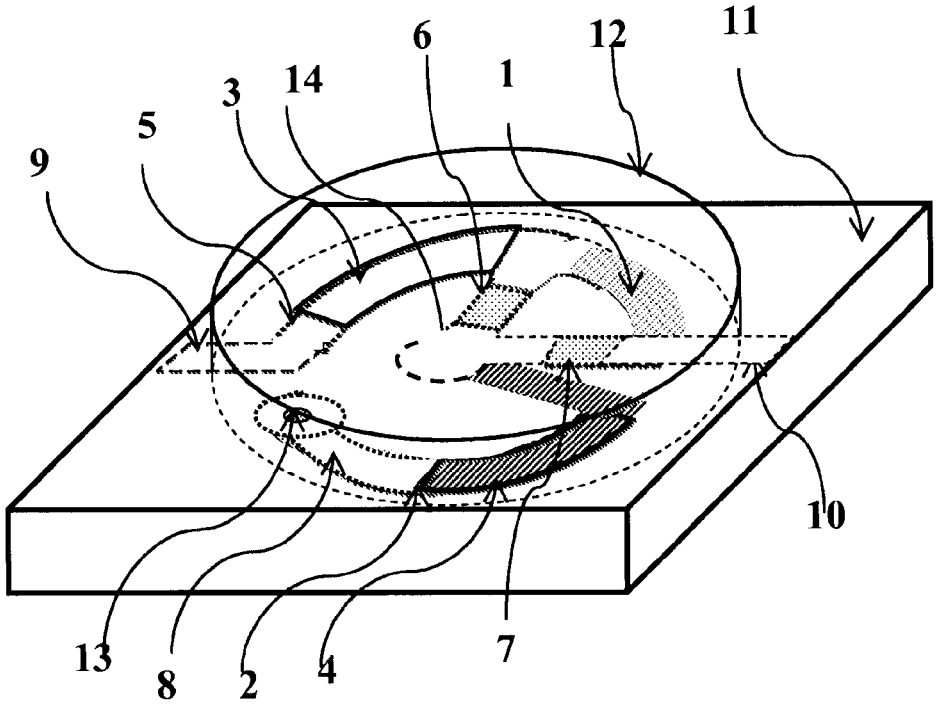
FIG. 1 is a structural diagram of a variable attenuator in accordance with one embodiment of the invention.
Figure 2:
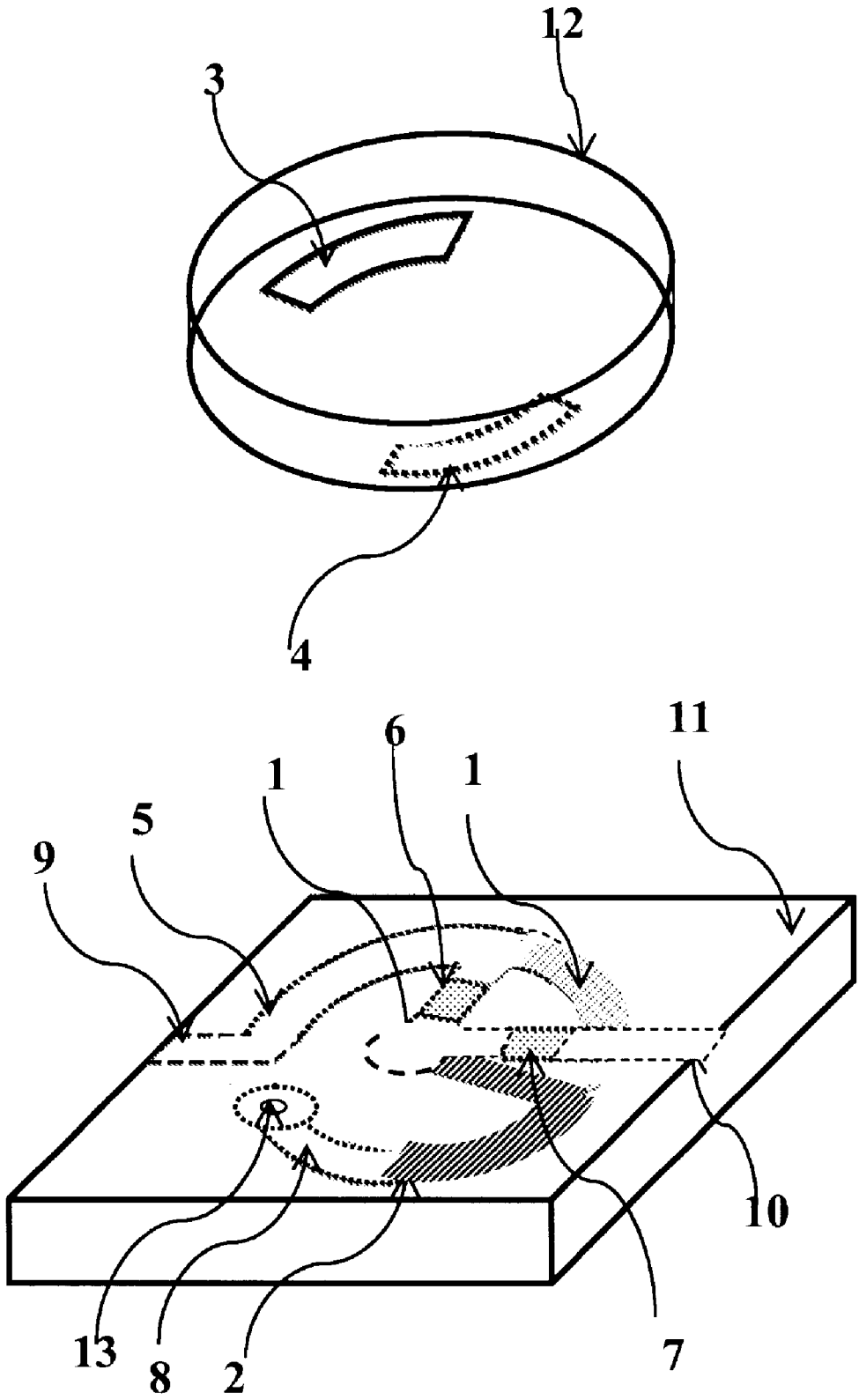
FIG. 2 is an exploded view thereof.

With reference to FIGS. 1-2, a variable attenuator according to the first embodiment of the invention comprises a base 11, an input terminal 9 located on the base 11, an arc shaped microstrip signal line 5 with one end connected to the input terminal 9, an arc shaped film resistor 1 with one end connected to the other end of the microstrip signal line 5, and an output terminal 10 connected to the other end of the film resistor 1. In addition, the two ends of the film resistor 1 are electrically connected to one end of a film resistor 6 and one end of a film resistor 7, respectively; the other ends 14 of the film resistor 6 and film resistor 7 are both electrically connected to one end of the film resistor 2, the other end of the film resistor 2 is connected to a ground terminal 13, or is connected to the ground terminal 13 via a microstrip signal line 8. In certain embodiments of the invention, the film resistor 1, the film resistor 2, the film resistor 6, and the film resistor 7 are all printed film resistors with the bottom side connected to the base 11 and the top side made of conductive and non-insulated material.

Particularly, the resistance value of the film resistor 6 is equal to that of the film resistor 7. Generally, the film resistor 6 and the film resistor 7 are film resistors having the same resistance value, Zo, at the input and output terminals, for example, 50 Ohms. A conductive sheet 3 for contact short-circuiting, and having the same shape as the microstrip signal line 5, is located above the top side of the microstrip signal line, and is fixed on the insulator 12. The insulator 12 is a forced displacement board, and is further fixed with a conductive sheet 4. The conductive sheet 3 and the conductive sheet 4 are fixed at the bottom side of the insulator 12 (namely the forced displacement board), respectively. The function of the conductive sheet 3 is to adjust the effective resistance value of the film resistor 1, while that of the conductive sheet 4 is to adjust the effective resistance value of the film resistor 2. The conductive sheet 3 does not contact with the conductive sheet 4. The conductive sheet 3 and the conductive sheet 4 rotate with the rotation of the insulator 12. For example, when the insulator 12 (the forced displacement board) rotates clockwise, the conductive sheet 3 rotates on and in contact with the microstrip signal line 5 and the film resistor 1 simultaneously. The contact area between the conductive sheet 3 and the film resistor 1 increases so that the resistance value of the film resistor 1 decreases. The conductive sheet 4 rotates on the microstrip signal line 8 and the film resistor 2 simultaneously. The contact area between the conductive sheet 4 and the film resistor 2 decreases so that the resistance value of the film resistor 2 increases. Through the change in the geometric area, namely the change in the contact area between the conductive sheet and the film resistor, the actual effective resistance values of the film resistor 1 and the film resistor 2 are changed.

When the insulator 12 (forced displacement board) rotates clockwise, it is preferred that the maximum rotation angle of the insulator 12 be maintained so as to make the conductive sheet 3 nearly or totally short-circuit the film resistor 1; the length (arc length) of the conductive sheet 3 should cover or nearly cover the film resistor 1, and should be prevented from contacting the film resistor 2. When the conductive sheet 4 rotates clockwise, the conductive sheet 4 needs to be designed not to contact the microstrip signal line 5 and the input terminal 9. Similarly, when the insulator 12 (forced displacement board) rotates counter-clockwise, the maximum rotation angle of the conductive sheet 4 needs to be maintained so as to avoid the conductive sheet 4 from contacting the output terminal 10. When the conductive sheet 3 rotates counter-clockwise, the conductive sheet 3 needs to be designed not to contact the ground terminal 13.

The conductive sheet 3 and the conductive sheet 4 can also be film resistors, which overlap and are electrically connected, and can be regarded as two resistors in parallel. Similarly, the resistance value of the film resistor can be changed and the same effect can be achieved. However, it is required that the conductive sheet 3 can only be used to electrically contact the film resistor 1 to change the resistance value thereof, and does not directly contact other microstrip signal lines or film resistors. It is required that the conductive sheet 4 can only be used to electrically contact the film resistor 2 to change the resistance value thereof, and does not directly contact other microstrip signal lines or film resistors. Therefore, the film resistor 1 and the film resistor 2 can be fabricated on the base 11 in different layers from other microstrip signal lines, the input and output terminals, and other film resistors so as to keep the basic principle and structure of the variable attenuator.

The co-plane of the film resistor 1 and the conductive sheet 3 is, without limitation, in the same plane as that of the film resistor 2 and the conductive sheet 4.

Figure 3:
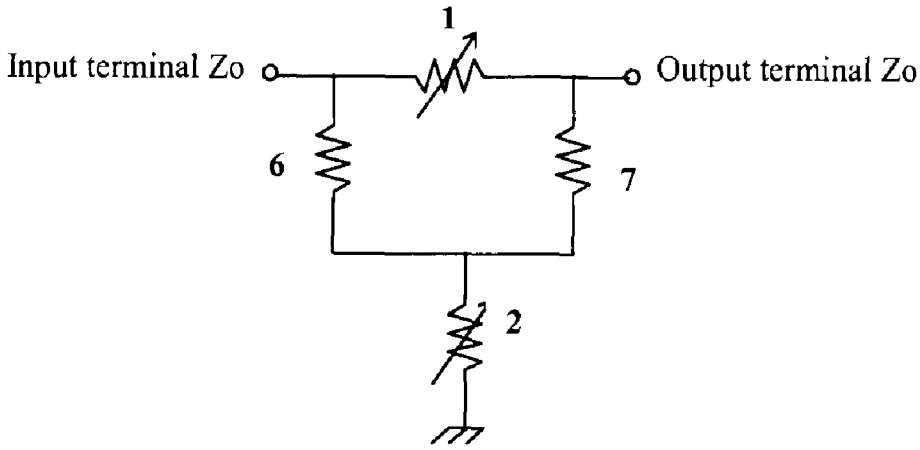
FIG. 3 is an equivalent electric diagram thereof.

FIG. 3 illustrates the basic principle diagram of the variable attenuator of the invention. The operation principle of the variable attenuator is equivalent to a continuous variable bridge T-shaped attenuator, which is a symmetric wide band network with interchangeable input and output terminals.

Figure 4:
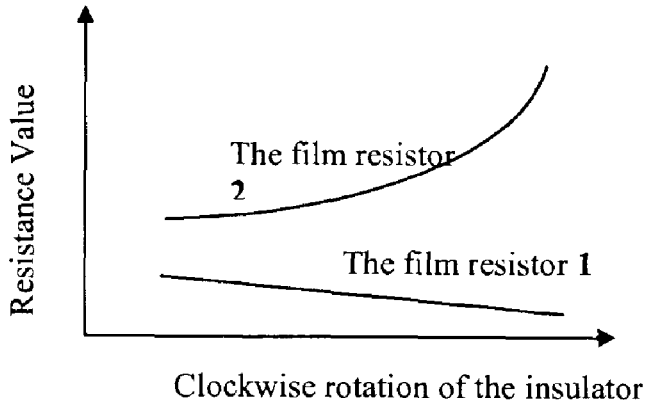
FIG. 4 shows a theoretical characteristic variation curve of the resistance value of the film resistor 1 and the film resistor 2, when the insulator drives the conductive sheet to rotate clockwise as the variable attenuator is adjusted by an external force, in accordance with one embodiment of the invention.

FIG. 4 illustrates an ideal theoretical variation curve of the film resistor 1 and the film resistor 2 when the insulator 12 (forced displacement board) rotates clockwise. The variation trend of the resistance value of the film resistor 1 is opposite to that of the film resistor 2.

Figure 5:
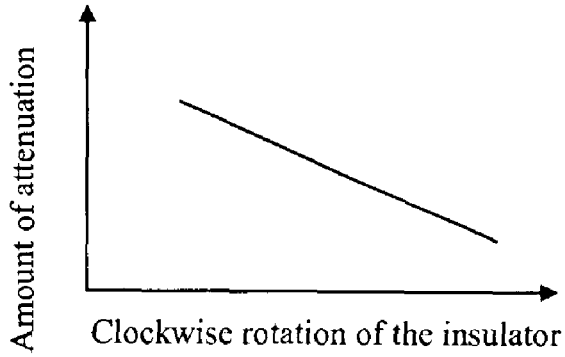
FIG. 5 shows an attenuation variation curve of a variable attenuator in accordance with one embodiment of the invention when the insulator drives the conductive sheet to rotate clockwise as the variable attenuator is adjusted by an external force.

FIG. 5 illustrates a line showing the attenuation amount of the variable attenuator fabricated according to the curve of FIG. 4 when the insulator 12 (forced displacement board) rotates clockwise. During designing and fabricating, the film resistor 1 and the film resistor 2 are chosen according to the curve of FIG. 4 so as to realize variation in the attenuation amount, which is required when the displacement of the variable attenuator is changed.

When the resistance value of one of the film resistors increases, the resistance value of the other film resistor decreases, and vice versa. Based on the variation trend of FIG. 3, a continuous variable attenuator can be fabricated.

The variable attenuator can be made into various package types, such as a surface mount type, a pin leg lead type, or a patch cord type.

In addition, in accordance with the invention, a silicon rubber film that is conductive in the vertical direction can be added between the base 11 and the insulator 12 so as to stabilize the contact between the film resistor and the conductive sheet, and thereby, to avoid wear between the film resistor and the conductive sheet.

Besides, in accordance with the invention, a groove can also be processed on the insulator 12, and the conductive sheet 3 and the conductive sheet 4 are located inside of the groove. An elastic substance having a negligible influence on the high frequency and microwave characteristics is added between the conductive sheet 3 and the conductive sheet 4 acting for contact short-circuiting within the groove so as to stabilize the contact between the film resistor and the conductive sheet, and thereby, to avoid wear between the film resistor and the conductive sheet.

The main feature of the variable attenuator of the invention is that in one plane (it can be multi layered), through the short-circuiting function of the conductive sheets, the resistance value of the film resistor 1 and the film resistor 2 can be simultaneously and flexibly changed in opposite directions. The conductive sheet 3, the conductive sheet 4, the film resistor 1, and the film resistor 2 can be in the geometric shape of an arc, rectangular, or other shape. The variable attenuator of the invention is miniaturized and cost-effective, and is suitable for use in the upper microwave frequency band.

Figure 6:
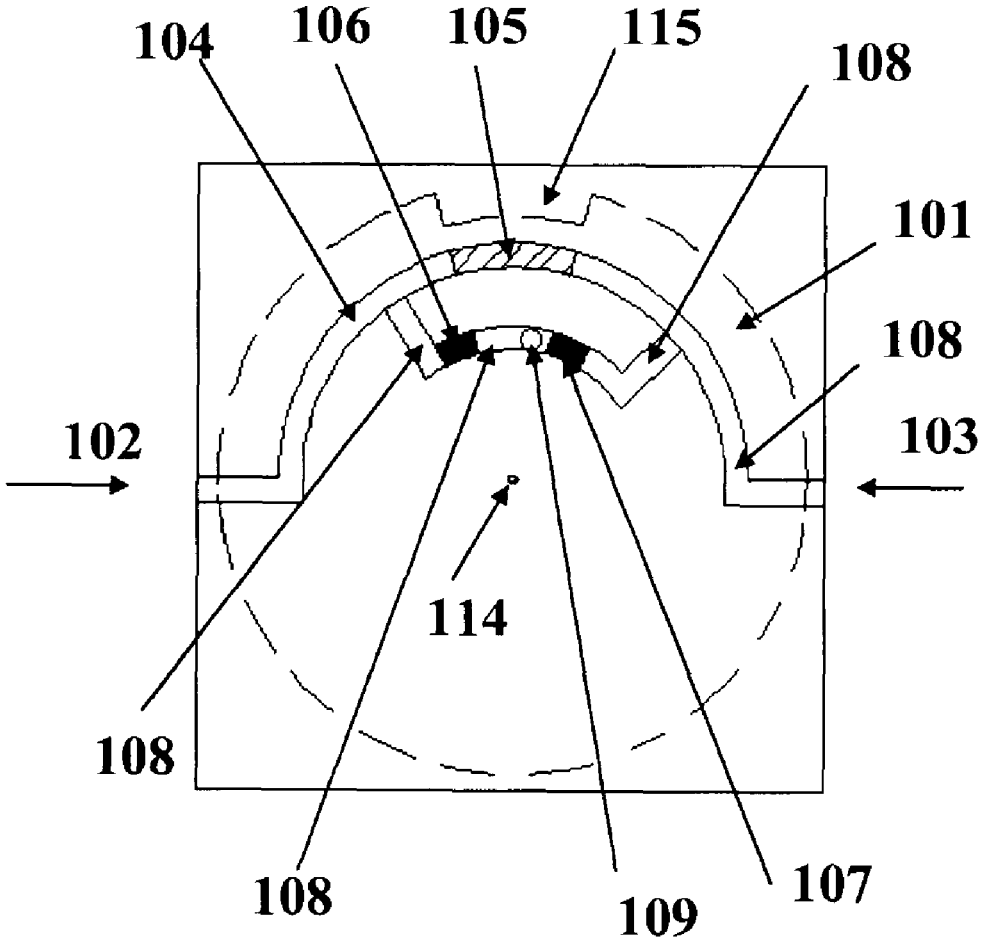
FIG. 6 is a structural diagram of a variable attenuator in accordance with a second embodiment of the invention.
Figure 7:
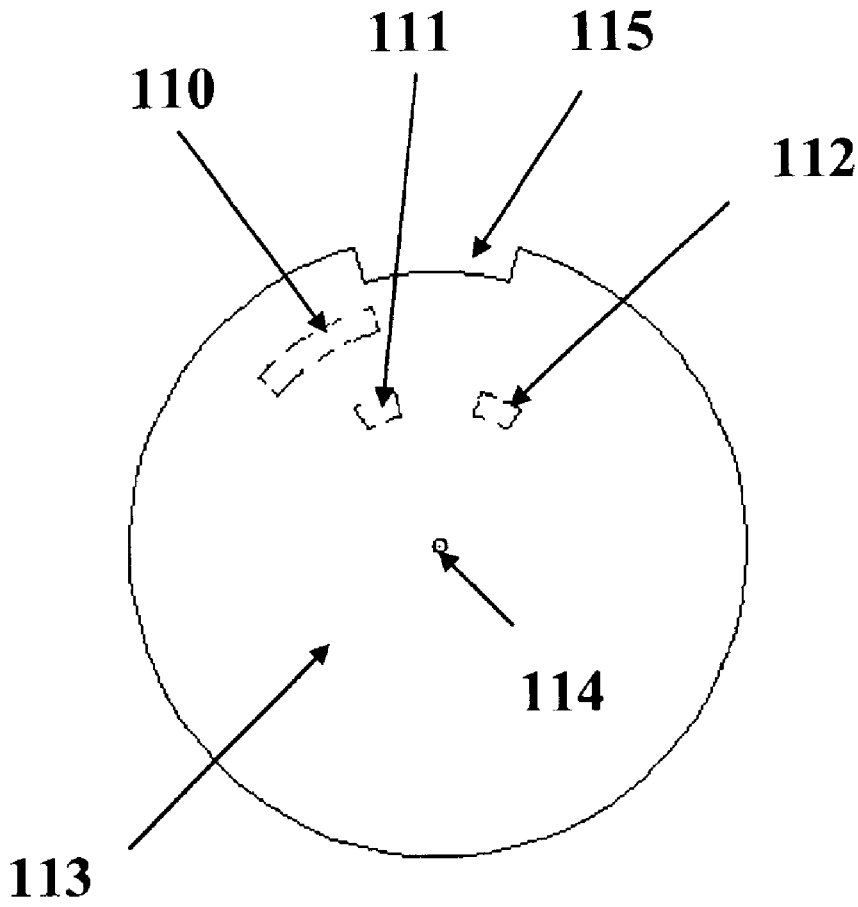
FIG. 7 is a structural diagram of a conductive sheet thereof.

FIGS. 6-7 illustrate the structural diagram of the microstrip variable attenuator and the structural diagram of the conductive sheet in accordance with the second embodiment of the invention, respectively, comprising: a base 101, an input terminal 102 and an output terminal 103 located on the base 101, an arc shaped strip film resistor 105, an arc shaped strip film resistor 106, an arc shaped strip film resistor 107, a microstrip signal line 104, a microstrip signal line 108, a ground terminal 109 for the connection of microstrip signal lines. The microstrip variable attenuator further comprises a conductive sheet 110, a conductive sheet 111, and a conductive sheet 112 disposed on an insulator 113. The insulator can also be a PCB board with conductive sheets disposed thereon. The PCB board can be in the shape of a circle for easy regulation. An arc mouth 115 is formed on the peripheral edge of the circle so as to limit the range of rotation regulation.

The base can be a ceramic base or a PCB board that is convenient to use with microstrip resistors.

One end of the microstrip signal line 104 is connected to the input terminal 102, while the other end is connected to the film resistor 105, and to one end of the film resistor 106 via the microstrip signal line 108. The other end of the film resistor 105 is connected to the output terminal 103. The other end of the film resistor 106 is connected to the ground terminal 109. One end of the film resistor 107 is connected to the output terminal 103 via the microstrip signal line 108, while the other end is connected to the ground terminal 109.

In certain embodiments of the invention, the film resistor 105, the film resistor 106, the film resistor 107 are all printed film resistors with the bottom side connected to the base 101 and the top side made of conductive and non-insulated material.

Particularly, the resistance value of the film resistor 106 is equal or close to that of the film resistor 107.

The base can be multi-layered, the film resistors and the conductive sheets can be in the shape of a strip arc, rectangular, or other shape. Particularly, the shape of the conductive sheet is the same as or similar to that of the film resistor.

The resistance value, Zo, is generally designed to be equal at the input and output terminals, for example, about 50 Ohms. The PCB board 113 and the base 101 share the same center 114. The PCB board 113 is installed on the base according to the position of the arc mouth 115, the side fixed with conductive sheets of the PCB board meets the base; a conductive sheet 110 for contact short-circuiting, and having the same shape as the microstrip signal line 104, is located above the top side of the microstrip signal line 104, and is fixed on the PCB board 113, which is further fixed with a conductive sheet 111 and a conductive sheet 112.

The function of the conductive sheet 110 is to adjust the resistance value of the film resistor 105. The function of the conductive sheet 111 is to adjust the resistance value of the film resistor 106, while that of the conductive sheet 112 is to adjust the resistance value of the film resistor 107. The conductive sheet 110, the conductive sheet 111, and the conductive sheet 112 rotate with the rotation of the PCB board 113. For example, when the PCB board 113 rotates clockwise by an external force, the conductive sheet 110 rotates on and in contact with the microstrip signal line 104 towards the film resistor 105, so that the contact area between the conductive sheet 110 and the film resistor 105 increases, and thus the resistance value of the film resistor 105 decreases. The conductive sheet 111 rotates on and in contact with the film resistor 106 towards the microstrip signal line 108, so that the contact area between the conductive sheet 111 and the film resistor 106 decreases, and thus the resistance value of the film resistor 106 increases. The conductive sheet 112 rotates on and in contact with the film resistor 107 towards the microstrip signal line 108 so that the contact area between the conductive sheet 112 and the film resistor 107 decreases, and thus the resistance value of the film resistor 107 increases. Through the change in the geometric area, namely the change in the contact area between the conductive sheet and the film resistor, the actual effective resistance values of the film resistor 105, the film resistor 106, and the film resistor 107 can be changed.

An arc mouth 115 is formed on the peripheral edge of the PCB board 113 to limit the range of the rotation regulation. When the PCB board 113 rotates clockwise, it is preferred that the maximum rotation angle of the PCB board 113 be maintained so as to make the conductive sheet 110 nearly or totally short-circuit the film resistor 105, and the length (arc length) of the conductive sheet 110 should cover or nearly cover the film resistor 105. It is preferred that the length (arc length) of the conductive sheet 111 should cover or nearly cover the film resistor 106. It is preferred that the length (arc length) of the conductive sheet 112 should cover or nearly cover the film resistor 107. Moreover, the spacing between the film resistor 106 and the film resistor 107 should be considered so that the conductive sheet 111 does not contact the film resistor 107 in the process of clockwise rotation.

Similarly, when the PCB board is rotated counter-clockwise by an external force, it is restricted to rotate only within the range of the arc mouth 115 so as to ensure that the conductive sheet 112 does not contact the film resistor 106. The design of the position of the conductive sheet 111 and the conductive sheet 112 at each of the maxima of rotational movement should account for the fact that that the effective resistance value of the film resistor 106 is equal or close to that of the film resistor 107.

The conductive sheet 110, the conductive sheet 111, and the conductive sheet 112 can also be film resistors, which overlap and are electrically connected, and so can be regarded as three resistors in parallel. Similarly, the resistance value of the film resistors can be changed and the same effect can be achieved. However, it is required that the conductive sheet 110 can only be used to electrically contact the film resistor 105 to change the resistance value thereof, and cannot directly contact other film resistors. It is required that the conductive sheet 111 can only be used to electrically contact the film resistor 106 to change the resistance value thereof, and cannot directly contact other film resistors. It is required that the conductive sheet 112 can only be used to electrically contact the film resistor 107 to change the resistance value thereof, and cannot directly contact other film resistors. This design can be realized by using multi-layered PCB board so as to keep the basic principle and structure of the microstrip variable attenuator.

Figure 8:
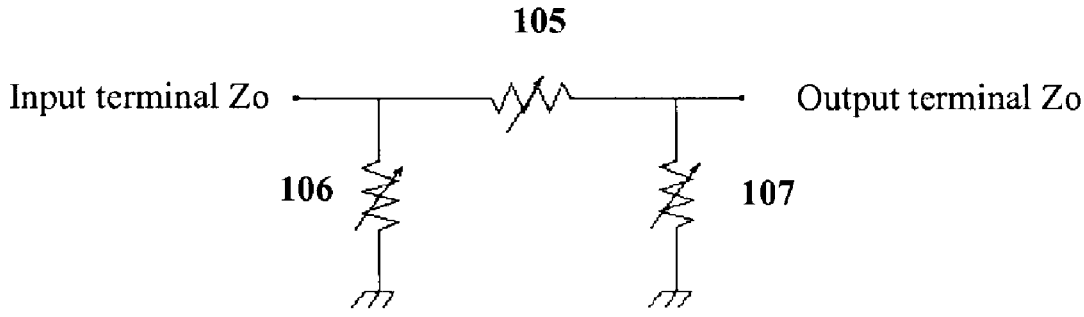
FIG. 8 is an equivalent electric diagram thereof.

With reference to FIG. 8, the equivalent circuit diagram of the microstrip variable attenuator according to a second embodiment of the invention is equivalent to that of a continuous variable π-shaped attenuator being a symmetric wide band network with interchangeable input and output terminals.

Figure 9:
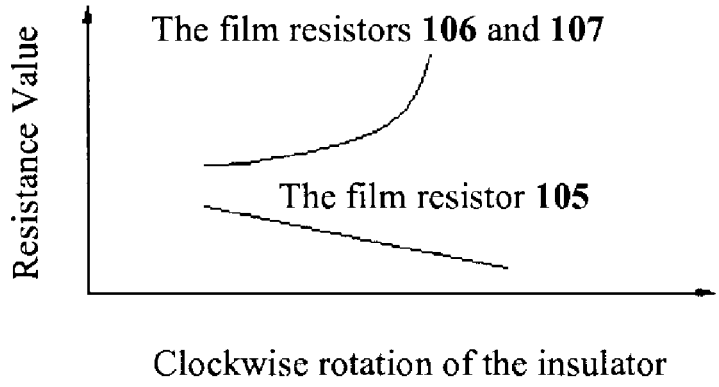
FIG. 9 shows a theoretical characteristic variation curve of the resistance value of the film resistor 105, the film resistor 106, and the film resistor 107 when the insulator drives the conductive sheet to rotate clockwise as the variable attenuator is adjusted by an external force, in accordance with a second embodiment of the invention.

FIG. 9 illustrates an ideal theoretical variation curve of the film resistor 105, the film resistor 106, and the film resistor 107 when the PCB board 113 is rotated clockwise by an external force. The variation trend of the resistance value of the film resistor 105 is opposite to those of the film resistor 106 and the film resistor 107.

Figure 10:
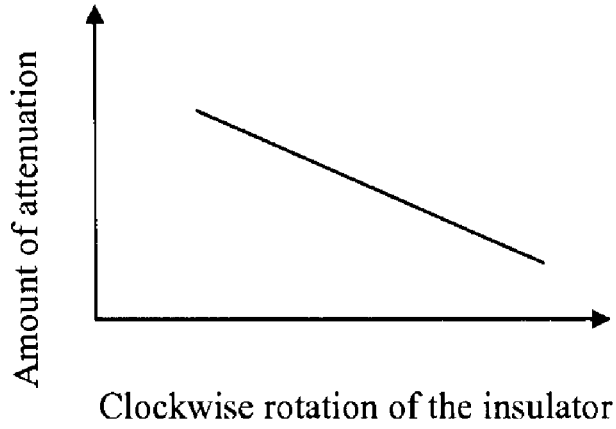
FIG. 10 shows an attenuation variation curve of a variable attenuator in accordance with a second embodiment of the invention when the insulator drives the conductive sheet to rotate clockwise as the variable attenuator is adjusted by an external force.

FIG. 10 illustrates a line showing the attenuation amount of the variable attenuator fabricated according to the curve of FIG. 9 when the PCB board 113 is rotated clockwise. During designing and fabricating, the film resistor 105, the film resistor 106, and the film resistor 107 are chosen according to the curve of FIG. 9 so as to realize variation in the attenuation amount, which is required when the displacement of the variable attenuator is changed.

The force to change the geometrical position of the conductive sheet 110, the conductive sheet 111, and the conductive sheet 112 can be a mechanical manual force, an automatic controlled mechanical force, an electromagnetic force, a force produced by heat or temperature, a force produced by the flow, expansion, or contraction of a liquid, or a force initiated by an optoelectronic excitation process.

The microstrip variable attenuator can be made into various package types, such as a surface mount type, a pin leg lead type, or a patch cord type.

The insulator and the conductive sheets of the present invention can be made of PCB board. The PCB board in the specified embodiments is a circle PCB board with an open arc mouth on its peripheral edge, and is concentric to the base for easy regulation. A block can be added on one end of the arc mouth to limit the rotation range of the PCB board so as to realize the optimal conformity, precise positioning, and precise regulation of the film resistors and the conductive sheets. Besides, an elastic film that is rigid in the rotation direction and is elastic in the vertical direction can be added between the PCB board 113 and the enclosure so as to keep the position of the PCB board after regulation and to stabilize the contact between the film resistor and the conductive sheet.

Figure 11:
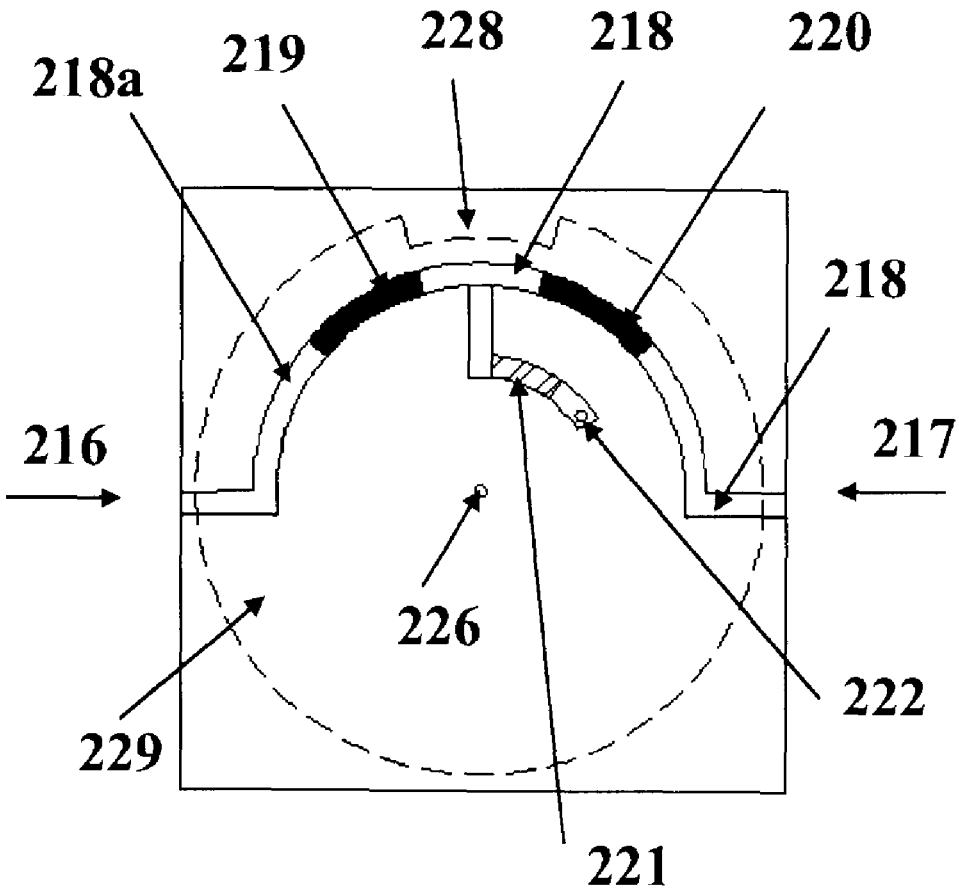
FIG. 11 is a structural diagram of a variable attenuator in accordance with a third embodiment of the invention.
Figure 12:
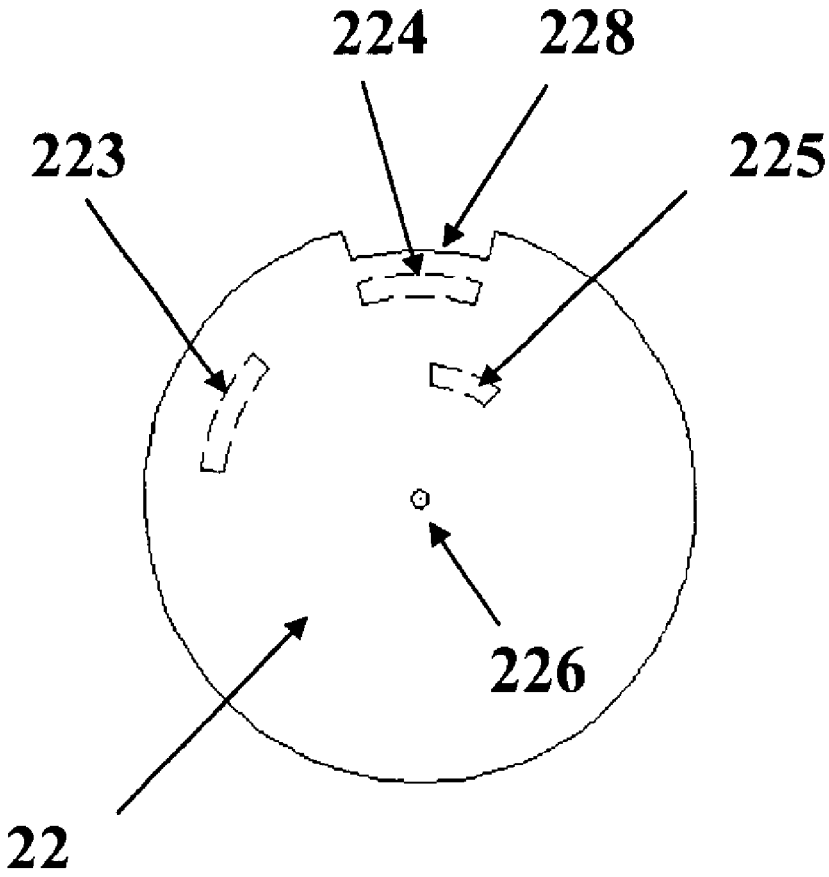
FIG. 12 is a structural diagram of a conductive sheet thereof.

FIGS. 11-12 illustrate the structural diagram of the microstrip variable attenuator and the structural diagram of the conductive sheet in accordance with the third embodiment of the invention, respectively, comprising: a base 229, an input terminal 216 and an output terminal 217 located on the base, an arc shaped strip film resistor 219, an arc shaped strip film resistor 220, an arc shaped strip film resistor 221, a microstrip signal line 218*a*, a microstrip signal line 218, a ground terminal 222 for the connection of the microstrip signal lines. The microstrip variable attenuator further comprises a conductive sheet 223, a conductive sheet 224, and a conductive sheet 225 disposed on an insulator 227.

A PCB board can also replace the insulator with conductive sheets disposed thereon. The PCB board can be in a circular shape for easy regulation. An arc mouth 228 is formed on the peripheral edge of the circle so as to limit the range of rotation regulation.

The base can be a ceramic base or a PCB board that is easy to process for microstrip resistors.

The input terminal 216 is connected to one end of the film resistor 219 via the microstrip signal line 218*a*, the other end of the film resistor 219 is connected to one end of the film resistor 220 via the microstrip signal line 218, and is connected to one end of the film resistor 221, the other end of the film resistor 221 is connected to the ground terminal 222; the other end of the film resistor 220 is connected to the output terminal 217 via the microstrip signal line.

In certain embodiments of the invention, the film resistor 219, the film resistor 220, the film resistor 221 are all printed film resistors with the bottom side connected to the base 229 and the top side made of conductive and non-insulated material.

Particularly, the resistance value of the film resistor 219 is equal or close to that of the film resistor 220.

The base can be multi-layered, the film resistors and the conductive sheets can be in the shape of a strip arc, rectangular, or other shape. Particularly, the shape of the conductive sheet is the same as or similar to that of the film resistor.

The resistance value, Zo, is generally designed to be equal at the input and output terminals, for example, about 50 Ohms. The PCB board 227 and the base 229 share the same center 226. The PCB board 227 is installed on the base according to the position of the arc mouth 228, the side fixed with conductive sheets of the PCB board meets the base; a conductive sheet 223 for contact short-circuiting, and having the same shape as the microstrip signal line 218*a*, is located above the top side of the microstrip signal line 218*a*, and is fixed on the PCB board 227, which is further fixed with a conductive sheet 224 and a conductive sheet 225.

The function of the conductive sheet 223 is to adjust the resistance value of the film resistor 219. The function of the conductive sheet 224 is to adjust the resistance value of the film resistor 220, while that of the conductive sheet 225 is to adjust the resistance value of the film resistor 221. The conductive sheet 223, the conductive sheet 224, and the conductive sheet 225 rotate with the rotation of the PCB board 227. For example, when the PCB board 227 is rotated clockwise by an external force, the conductive sheet 223 rotates in contact from the microstrip signal line toward the film resistor 219, so that the contact area between the conductive sheet 223 and the film resistor 219 increases, and thus the resistance value of the film resistor 219 decreases. The conductive sheet 224 rotates in contact from the microstrip signal line toward the film resistor 220, so that the contact area between the conductive sheet 224 and the film resistor 220 increases, and thus the resistance value of the film resistor 220 decreases. The conductive sheet 225 rotates in contact from the film resistor 221 towards the microstrip signal line so that the contact area between the conductive sheet 225 and the film resistor 221 decreases, and thus the resistance value of the film resistor 221 increases. Through the change in the geometric area, namely the change in the contact area between the conductive sheet and the film resistor, the actual effective resistance values of the film resistor 219, the film resistor 220, and the film resistor 221 can be changed.

An arc mouth 228 is formed on the peripheral edge of the PCB board 227 to limit the range of the rotation regulation. When the PCB board 227 rotates clockwise, it is preferred that the maximum rotation angle of the PCB board 227 be maintained so as to make the conductive sheet 223 nearly or totally short-circuit the film resistor 219, and the length (arc length) of the conductive sheet 223 should cover or nearly cover the film resistor 219. Moreover, the spacing between the film resistor 219 and the film resistor 220 should be taken into account so that the conductive sheet 223 does not contact the film resistor 220 in the process of clockwise rotation. Similarly, when the PCB board 227 is rotated counter-clockwise by an external force, it can only rotate within the range of the arc mouth 228 so as to ensure that the conductive sheet 224 does not contact the film resistor 219.

The design of position of the conductive sheet 223 and the conductive sheet 224 at each of the maxima of the rotational movement, respectively, should account for the fact that the effective resistance value of the film resistor 219 is equal or close to that of the film resistor 220.

The conductive sheets can also be film resistors, which overlap and are electrically connected, and so can be regarded as three resistors in parallel. Similarly, the resistance value of the film resistor can be changed and the same effect can be achieved. However, it is required that the conductive sheet 223 can only be used to electrically contact the film resistor 219 to change the resistance value thereof, and does not directly contact other film resistors. It is required that the conductive sheet 224 can only be used to electrically contact the film resistor 220 to change the resistance value thereof, and does not directly contact other film resistors. It is required that the conductive sheet 225 can only be used to electrically contact the film resistor 221 to change the resistance value thereof, and does not directly contact other film resistors. This design can be realized by using multi-layered PCB board so as to keep the basic principle and structure of the microstrip variable attenuator.

Figure 13:
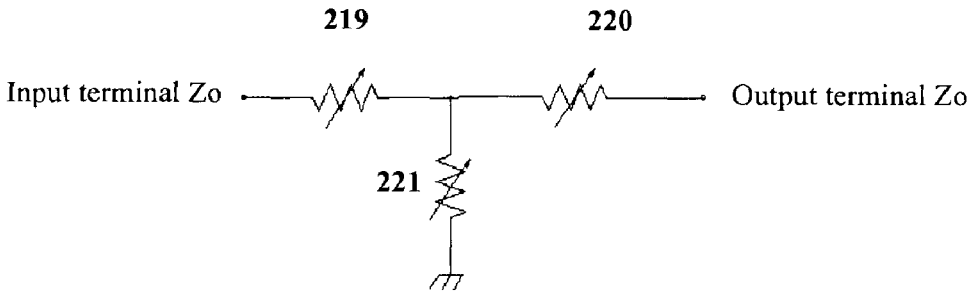
FIG. 13 is an equivalent electric diagram thereof.

With reference to FIG. 13, the equivalent circuit diagram of the microstrip variable attenuator according to the third embodiment of the invention is equivalent to that of a continuous variable T-shaped attenuator being a symmetric wide band network with interchangeable input and output terminals.

Figure 14:
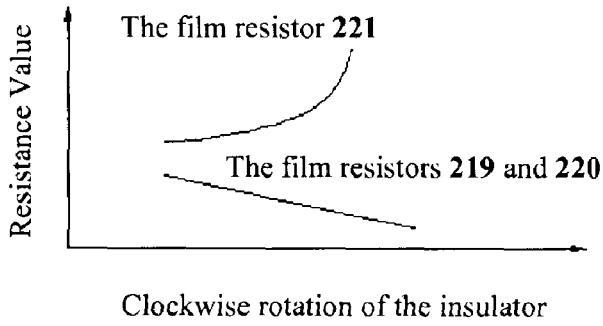
FIG. 14 shows a theoretical characteristic variation curve of the resistance value of the film resistor 219, the film resistor 220, and the film resistor 221 when the insulator drives the conductive sheet to rotate clockwise as the variable attenuator is adjusted by an external force, in accordance with a third embodiment of the invention.

FIG. 14 illustrates an ideal theoretical variation curve of the film resistor 219, the film resistor 220, and the film resistor 221 when the PCB board 227 is rotated clockwise by an external force. The variation trend of the resistance value of the film resistor 219 and of the film resistor 220 is opposite to that of the film resistor 221.

Figure 15:
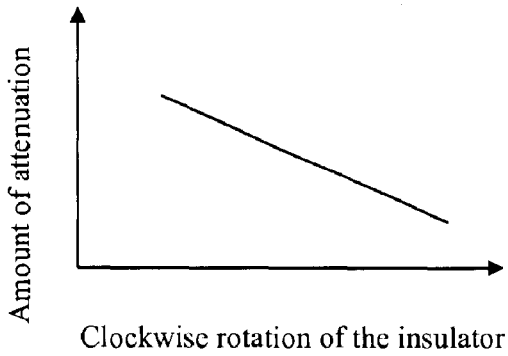
FIG. 15 shows an attenuation variation curve of a variable attenuator in accordance with a third embodiment of the invention when the insulator drives the conductive sheet to rotate clockwise as the variable attenuator is adjusted by an external force.

FIG. 15 illustrates a line showing the attenuation amount of the variable attenuator fabricated according to the curve of FIG. 14 when the PCB board 227 is rotated clockwise. During designing and fabricating, the film resistor 219, the film resistor 220, and the film resistor 221 are chosen according to the curve of FIG. 14 so as to realize variation in the attenuation amount, which is required when the displacement of the variable attenuator is changed.

The force to change the geometrical position of the conductive sheet 223, the conductive sheet 224, and the conductive sheet 225 is a mechanical manual force, an automatic controlled mechanical force, an electromagnetic force, a force produced by heat or temperature, a force produced by the flow, expansion, or contraction of a liquid, or a force initiated by an optoelectronic excitation process.

The microstrip variable attenuator can be made into various package types, such as a surface mount type, a pin leg lead type, or a patch cord type.

The insulator and the conductive sheets of the present invention can be made of PCB board. The PCB board in the specified embodiments is a circle PCB board with an open arc mouth on its peripheral edge, and is concentric to the base for easy regulation. A block can be added on one end of the arc mouth to limit the rotation range of the PCB board so as to realize the optimal conformity, precise positioning, and precise regulation of the film resistors and the conductive sheets. Besides, an elastic film that is rigid in the rotation direction and is elastic in the vertical direction can be added between the PCB board 227 and the enclosure so as to keep the position of the PCB board after regulation and to stabilize the contact between the film resistor and the conductive sheet.

This invention is not to be limited to the specific embodiments disclosed herein and modifications for various applications and other embodiments are intended to be included within the scope of the appended claims. While this invention has been described in connection with particular examples thereof, the true scope of the invention should not be so limited since other modifications will become apparent to the skilled practitioner upon a study of the drawings, specification, and following claims.

All publications and patent applications mentioned in this specification are indicative of the level of skill of those skilled in the art to which this invention pertains. All publications and patent applications mentioned in this specification are herein incorporated by reference to the same extent as if each individual publication or patent application mentioned in this specification was specifically and individually indicated to be incorporated by reference.

Figure 16:
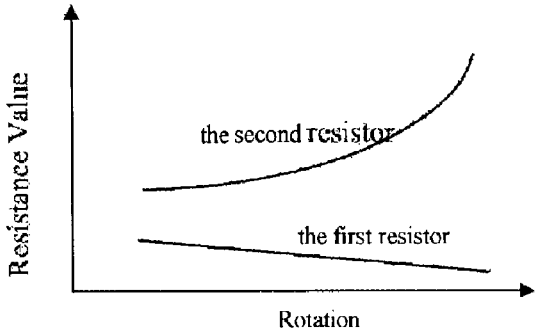
FIG. 16 shows a graph of how the first effective resistance value changes when the first conductive sheet rotates with respect to the first resistor and how the second effective resistance value changes in certain embodiments when the second conductive sheet rotates with respect to the second resistor.

What is claimed is:

1. A variable attenuator, comprising:

a first resistor having a first effective resistance value;

a second resistor having a second effective resistance value;

a first conductive sheet;

a second conductive sheet;

wherein said first conductive sheet can be electrically contacted with at least a portion of said first resistor whereby changing said first effective resistance value according to the following figure when said first conductive sheet rotates with respect to said first resistor; and said second conductive sheet can be electrically contacted with at least a portion of said second resistor whereby changing said second effective resistance value according to FIG. 16 when said second conductive sheet rotates with respect to said second resistor.

2. The variable attenuator of claim 1, further comprising a base, wherein said first resistor and said second resistor are disposed on said base.

3. The variable attenuator of claim 2, further comprising an insulator, said insulator being movable with respect to said base, wherein said first conductive sheet and said second conductive sheet are disposed on said insulator.

4. A variable attenuator comprising:

a first resistor having a first effective resistance value;

a second resistor having a second effective resistance value;

a first conductive sheet;

a second conductive sheet;

a base;

an insulator, said insulator being movable with respect to said base;

a third resistor having a third resistance value and having a first third resistor end and a second third resistor end;

a fourth resistor having a fourth resistance value and having a first fourth resistor end and a second fourth resistor end;

an input terminal;

an output terminal; and a ground terminal;

wherein said first conductive sheet can be electrically contacted with at least with a portion of said first resistor whereby changing said first effective resistance value;

said second conductive sheet can be electrically contacted with at least a portion of said second resistor whereby changing said second effective resistance value;

said first resistor and said second resistor are disposed on said base;

said first conductive sheet and said second conductive sheet are disposed on said insulator;

said first resistor has a first resistor end and a second first resistor end;

said input terminal is electrically connected to said first resistor end;

said output terminal is electrically connected to said second first resistor end;

said first resistor end is electrically connected to said first third resistor end;

said second first resistor end is electrically connected to said first fourth resistor end;

said second third resistor end is electrically connected to said first second resistor end;

said second fourth resistor end is electrically connected to said first second resistor end; and said second second resistor end is electrically connected to said ground terminal.

5. The variable attenuator of claim 4, wherein said third resistance value is equal to said fourth resistance value.

6. The variable attenuator of claim 3, wherein moving said insulator with respect to said base simultaneously changes said first effective resistance value and said second effective resistance value.

7. The variable attenuator of claim 3, further comprising a first electrical contact area between said first resistor and said first conductive sheet; and a second electrical contact area between said second resistor and said second conductive sheet, wherein the position of said insulator with respect to said base simultaneously changes said first electrical contact area and said second electrical contact area.

8. The variable attenuator of claim 1, wherein said first resistor, said second resistor, said first conductive sheet, and said second conductive sheet are parallel in space to one another, and are located in a common geometrical plane or in different geometrical planes.

9. The variable attenuator of claim 3, wherein said insulator is movable with respect to said base by an external force, said external force being selected from a group consisting of: a manual mechanical force, an automatically-controlled mechanical force, an electromagnetic force, a force produced by changes in heat or temperature, a force produced by flow, expansion, or contraction of a liquid, or a force produced by an optoelectronic excitation process.

10. The variable attenuator of claim 3, wherein moving said insulator with respect to said base simultaneously (i) increases said first effective resistance value and decreases said second effective resistance value, or (ii) decreases said first effective resistance value and increases said second effective resistance value.

11. The variable attenuator of claim 3, wherein said insulator is rotatable with respect to said base around an axis of rotation.

12. The variable attenuator of claim 3, wherein said insulator can assume a first position and a second position, said second position being in a clockwise rotating direction with respect to said first position, and said first effective resistance value is lower when said insulator is in said first position than when said insulator is in said second position.

13. The variable attenuator of claim 3, wherein said insulator can assume a first position and a second position, said second position being in a clockwise rotating direction with respect to said first position, and said second effective resistance value is lower when said insulator is in said first position than when said insulator is in said second position.

14. The variable attenuator of claim 3, further comprising: a third resistor having a third effective resistance value; and a third conductive sheet; wherein said third conductive sheet can be electrically contacted at least with a portion of said third resistor whereby changing said third effective resistance value.

15. A variable attenuator, comprising:

a first resistor having a first effective resistance value;

a second resistor having a second effective resistance value;

a first conductive sheet;

a second conductive sheet;

wherein said first conductive sheet can be electrically contacted with and rotated with respect to at least with a portion of said first resistor whereby linearly changing said first effective resistance value;

said second conductive sheet can be electrically contacted with and rotated with respect to at least a portion of said second resistor whereby non-linearly changing said second effective resistance value.

16. The variable attenuator of claim 15, further comprising:

a third resistor having a third effective resistance value; and a third conductive sheet;

wherein said third conductive sheet can be electrically contacted with and rotated with respect to at least with a portion of said third resistor whereby non-linearly changing said third effective resistance value.

17. The variable attenuator of claim 16, wherein said variable attenuator is equivalent to a continuous variable π-shaped attenuator being a symmetric wide band network with interchangeable input and output terminals.

18. The variable attenuator of claim 16, wherein said first resistor has a first resistor end and a second first resistor end;

said second resistor has a first second resistor end and a second resistor end;

said third resistor has a first third resistor end and a second third resistor end;

said input terminal is electrically connected to said first resistor end;

said output terminal is electrically connected to said second first resistor end;

said first second resistor end is electrically connected to said first resistor end;

said second resistor end is electrically connected to said ground terminal;

said first third resistor end is electrically connected to said ground terminal;

said second third resistor end is electrically connected to said second first resistor end.

19. The variable attenuator of claim 15, further comprising:

a third resistor having a third effective resistance value; and a third conductive sheet;

wherein said third conductive sheet can be electrically contacted with and rotated with respect to at least with a portion of said third resistor whereby linearly changing said third effective resistance value.

20. The variable attenuator of claim 19, wherein said variable attenuator is equivalent to a continuous variable T-shaped attenuator being a symmetric wide band network with interchangeable input and output terminals.

21. The variable attenuator of claim 19, wherein said first resistor has a first resistor end and a second first resistor end;

said second resistor has a first second resistor end and a second resistor end;

said third resistor has a first third resistor end and a second third resistor end;

said first resistor end is electrically connected to said input terminal;

said second resistor end is electrically connected to said output terminal;

said second first resistor end is electrically connected to said first second resistor end;

said first third resistor end is electrically connected to said second first resistor end;

said first third resistor end is electrically connected to said first second resistor end;

said second third resistor end is electrically connected to said ground terminal.

Figure 17:
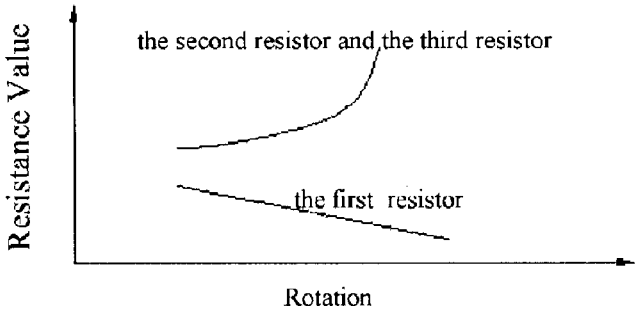
FIG. 17 shows a graph of how the third effective resistance value changes in certain embodiments when the third conductive sheet rotates with respect to the third resistor.
Figure 18:
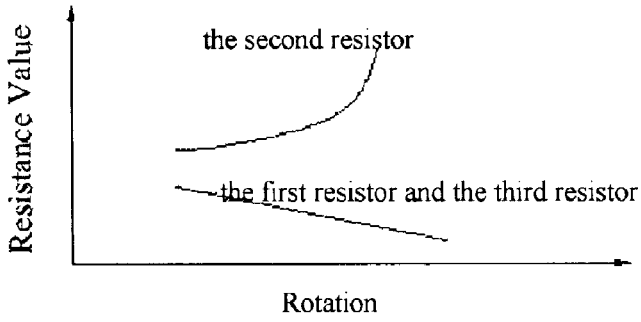
FIG. 18 shows a graph of how the third effective resistance value changes in certain embodiments when the third conductive sheet rotates with respect to the third resistor.

22. The variable attenuator of claim 1, further comprising a third resistor having a third effective resistance value; and a third conductive sheet;

wherein said third conductive sheet can be electrically contacted with at least a portion of said third resistor whereby changing said third effective resistance value according to FIG. 17 when said third conductive sheet rotates with respect to said third resistor.

23. The variable attenuator of claim 1, further comprising a third resistor having a third effective resistance value; and a third conductive sheet; wherein said third conductive sheet can be electrically contacted with at least a portion of said third resistor whereby changing said third effective resistance value according to the following figure when said third conductive sheet rotates with respect to said third resistor.

* * * * *